US005467856A

United States Patent [19]

Okada

[11] Patent Number: 5,467,856

[45] Date of Patent: Nov. 21, 1995

[54] GAMING MACHINE AND METHOD OF DETECTING FRAUD IN THE SAME

[75] Inventor: Kazuo Okada, Tokyo, Japan

[73] Assignee: Kabushiki Kaisha Universal, Tochigi, Japan

[21] Appl. No.: 87,402

[22] Filed: Jul. 8, 1993

[30] Foreign Application Priority Data

Jul. 8, 1992 [JP] Japan ..... 4-180912

[51] Int. Cl.[6] ..... G07F 17/34

[52] U.S. Cl. ..... 194/202; 273/138 A

[58] Field of Search ..... 194/200, 201, 194/202; 273/138 A; 364/410, 412

[56] References Cited

U.S. PATENT DOCUMENTS 4,567,592 1/1986 Minicilli ..... 371/20

4,773,647 9/1988 Okada et al. ..... 273/143 R 5,257,179 10/1993 De Mar ..... 273/138 A X

FOREIGN PATENT DOCUMENTS 0178278 4/1986 European Pat. Off. ..... 194/202

*Primary Examiner*—F. J. Bartuska

*Attorney, Agent, or Firm*—Young & Thompson

[57] ABSTRACT

A slot machine has a coin sensor, which is connected to a CPU via a signal line, and generates a coin-detecting signal upon insertion of a coin. The slot machine stands by for execution of a game in response to the coin insertion, under the control of the CPU. A reel-stop switch is connected to the CPU via a signal line, and generates a reel-stop signal in response to a button depression. A test signal generator outputs a test signal to the signal line of the reel-stop switch. The CPU checks the signal line of the coin sensor. If the test signal is detected through the signal line of the coin sensor, execution of the game is inhibited, whereby a fraudulent operation is detected.

24 Claims, 4 Drawing Sheets

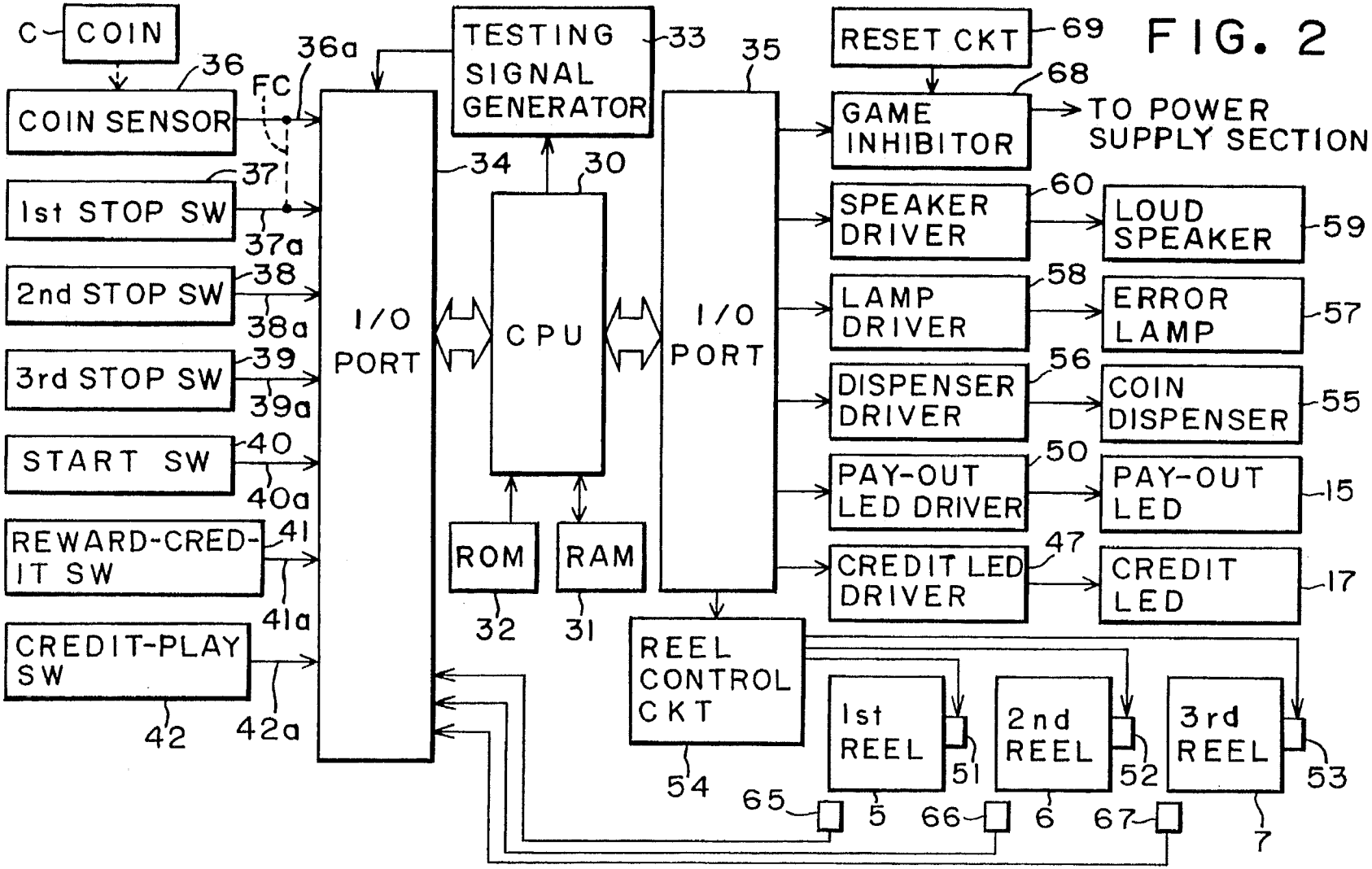
FIG. 2
TO POWER SUPPLY SECTION
RESET CKT
GAME INHIBITOR
SPEAKER DRIVER
LAMP DRIVER
DISPENSER DRIVER
PAY-OUT LED DRIVER
CREDIT LED DRIVER
LOUD SPEAKER
ERROR LAMP
COIN DISPENSER
PAY-OUT LED
CREDIT LED
3rd REEL
2nd REEL
1st REEL
REEL CONTROL CKT
I/O PORT
CPU
RAM
ROM
TESTING SIGNAL GENERATOR
I/O PORT
COIN
COIN SENSOR
1st STOP SW
2nd STOP SW
3rd STOP SW
START SW
REWARD-CREDIT SW
CREDIT-PLAY SW
C
FC
69
68
60
58
56
50
47
59
57
55
15
17
53
7
52
6
51
5
67
66
65
54
35
33
30
31
32
34
36a
36
37
37a
38
38a
39
39a
40
40a
41
41a
42a
42

GAMING MACHINE AND METHOD OF DETECTING FRAUD IN THE SAME

BACKGROUND OF THE INVENTION

1. Field of the Invention

The present invention relates to a gaming machine such as a slot machine, and a method of detecting fraud in the same. More particularly, the present invention relates to a gaming machine constructed with a view toward preventing the fraud of a player being able to play a game without inserting a coin, and a method of detecting such fraud.

2. Description of the Related Art

A gaming machine such as a slot machine is operated in response to insertion of coins, medals, tokens or other disks (herein referred to as coins) into a coin slot. The gaming machine incorporates a CPU, which effects control according to a stored program. The CPU receives signals generated by signal generators, including switches and sensors, so as to execute a control sequence: when a coin is inserted, a coin sensor sends a coin-detect signal at a High level to the CPU, which in response to the coin-detect signal brings a starter lever to a standby condition for actuation. Then the starter lever is operated, to cause a starter switch to generate a start signal at a High level. The CPU in response to the start signal starts rotating the three reels simultaneously. Stop buttons are next depressed, to generate a reel-stop signal at a High level. The CPU controls a reel control circuit to stop the reels. If symbols are stopped along a winning line, namely a line defined horizontally or diagonally across the reels, in a combination predetermined as winning, then the CPU causes a coin dispenser to pay out coins of a number associated with the winning grade of the symbol combination, to end one game. If symbols are stopped not in a wining combination, the game ends in a loss.

Conventional slot machines, however, suffer from the disadvantage of being vulnerable to fraud, by use of an additional false connection FC between signal lines of the coin sensor and of one of the stop buttons (FIG. 2). A dishonest player depresses the stop button associated with the additional connection FC, causes the additional connection FC to transmit a reel-stop signal through a signal line of the coin sensor, and this sends the High-level signal to the CPU, which would recognize the reel-stop signal as a coin-detection signal. The CPU would bring the starter lever to standby for actuation, despite the fact that there has been no insertion of a coin. This would require that the player have the cooperation of an employee in possession of keys to the amusement facilities. A front panel of the slot machine would be unlocked and opened by use of a key. It is thereafter easy to attach a piece of wire to interconnect the two signal lines.

OBJECT OF THE INVENTION

In view of the foregoing problems, an object of the present invention is to provide a gaming machine capable of preventing the fraudulent play of a game without inserting a coin, and a method of detecting such fraud.

SUMMARY OF THE INVENTION

In order to achieve the above and other objects and advantages of this invention, a gaming machine of the present invention, in response to a first external operation, becomes enabled to execute a game. A controller executes the game. First signal generator means generates a first signal representing a game-enabled state in response to the first external operation so as to send the first signal to the controller. Second signal generator means generates a second signal in response to a second external operation performed before determination of the reward so as to send the second signal to the controller. Test signal generator means sends a test signal toward the second signal generator means. The controller checks a signal from the first signal generator means during generation of the test signal and, if the test signal is detected in the checked signal, inhibits execution of the game because of fraudulent operation.

It is also possible that the test signal generator means sends a test signal toward the second signal generator means, and that the controller checks a signal from the second signal generator means during generation of the test signal.

If the stop button is associated with the fraudulent additional connection, the additional connection can be caused to transmit a reel-stop signal of the stop button through a signal line of the coin sensor. The reel-stop signal is never mistaken for a coin-detection signal. An actual coin-detection signal must be generated before the starter lever can be set to stand by for actuation.

Even if the stop button having the manipulated stop switch should be depressed, a fraud can be signaled by an alarm. The novel gaming machine will thus never be vulnerable to fraud by use of an additional connection between signal lines from the coin sensor and one of the stop buttons.

Even when a wire is attached to interconnect the two signal lines after unlocking a front panel of the slot machine, the conspiracy of a player with an employee having keys to the amusement facilities, will be prevented.

BRIEF DESCRIPTION OF THE DRAWINGS

The above objects and advantages of the present invention will become more apparent from the following detailed description when read in connection with the accompanying drawings, in which:

FIG. 2 is a circuit block diagram illustrating the electrical arrangement of the slot machine;

DETAILED DESCRIPTION OF THE PREFERRED EMBODIMENTS

Figure 1:
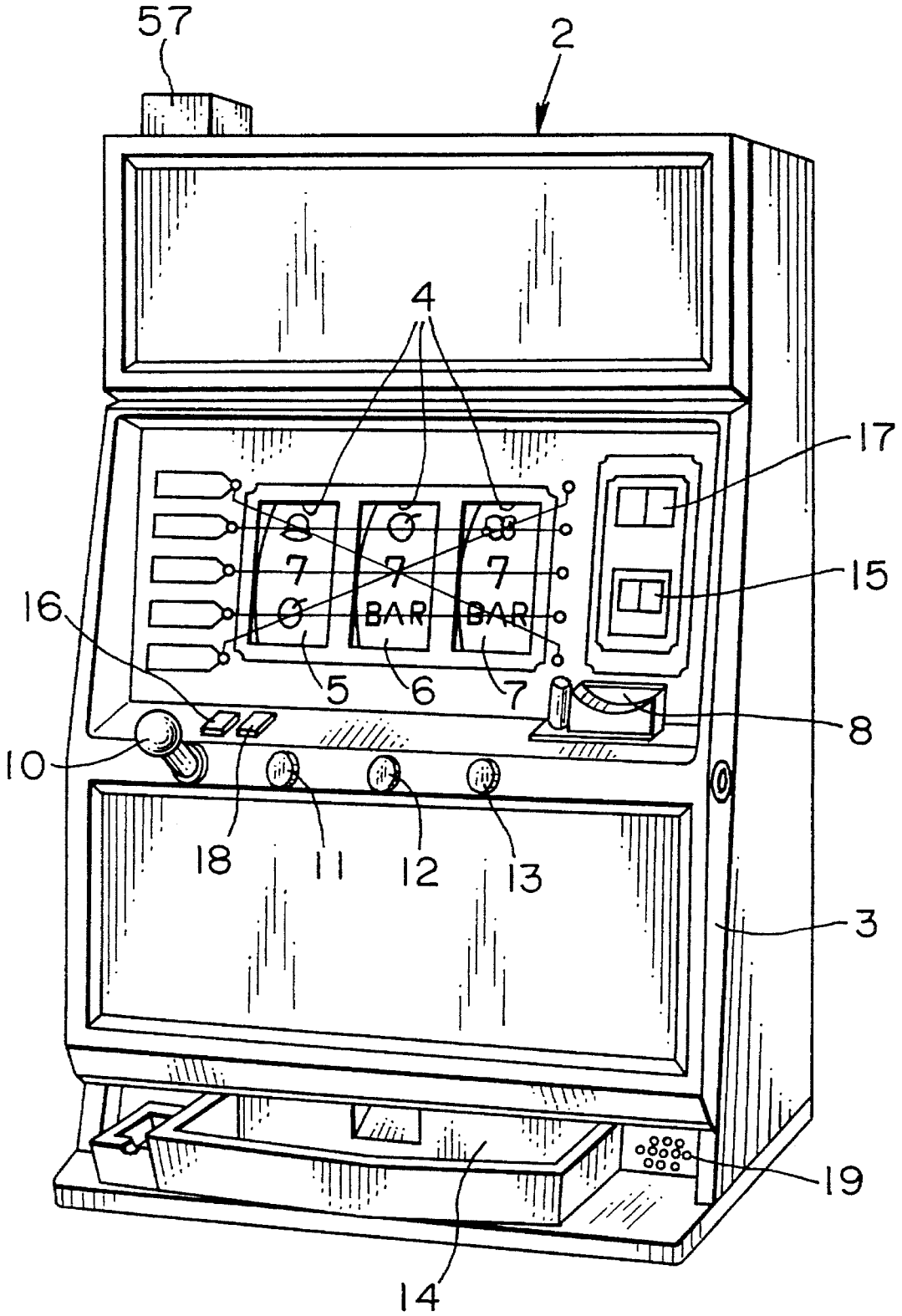
FIG. 1 is a perspective view illustrating a novel slot machine according to the invention.

In FIG. 1 illustrating a slot machine according to the present invention, a body 2 is provided with a front panel 3 openably mounted thereon. In the front panel 3 are formed display windows 4. Reels 5, 6 and 7 are incorporated in the body 2, and have trains of symbols or indicia visible through the display windows 4. In the front panel 3 is formed a coin slot 8. A player is allowed to insert through the coin slot 8 one or more coins C, at most three at a time, in advance of starting a game. Depending upon the number of the coins inserted, the number of validated winning lines is determined, where a winning line is defined as one along which a combination of symbols is judged as to whether it constitutes a win or loss, as is known to those skilled in the art of gaming machines.

The interior of the coin slot 8 communicates with a coin selector for selecting acceptable coins C as inserted, as is known in the art, and a coin censor 36 (see FIG. 2) detects the acceptable coins C as selected by the coin selector. After insertion of at least one coin C, a starter lever 10 is placed on stand by for actuation according to a normal sequence of a game. When the starter lever 10 is operated, the reels 5 to 7 start rotating. Respective stop buttons 11 to 13 are associated with the reels 5 to 7, and are adapted to be depressed during rotation of the reels 5 to 7 so as to stop them individually.

When the reels 5 to 7 are stopped and a combination of symbols along a validated winning line is judged as a win, then coins are paid out to a receptacle 14 in a number predetermined according to the particular winning combination of symbols. The number of coins to be paid out is indicated on a pay-out indicator LED (light-emitting diode) 15 located over the coin slot 8. If a reward-credit button 16 arranged near the starter 10 is depressed once, then no coins are paid out but the number of coins is indicated on a credit indicator LED 17. When the credit LED 17 indicates a sufficient number, a credit-play button 18 is validated. With the credit-play button 18 depressed without inserting any coins C, the starter 10 is placed on stand by for actuation to play another game. Beside the receptacle 14 is arranged a loudspeaker box 19. If the reward-credit button 16 is depressed a second time, then all coins credited are paid out.

In FIG. 2 illustrating the electrical arrangement of the slot machine, a CPU 30 is connected to a RAM 31 for writing data generated by sensors and switches, a ROM 32 storing a program for control of the slot machine, a test signal generator 33 for generating a test signal of pulses for a predetermined period, and two I/O ports 34 and 35. To the I/O port 34, the coin sensor 36 is connected for sending a coin-detection signal to the CPU 30 for each detection of an acceptable coin C inserted in the coin slot 8. The I/O port 34 is connected to stop switches 37 to 39 associated with the stop buttons 11 to 13 for generating reel-stop signals respectively for the reels 5 to 7. Port 34 is further connected to a start switch 40 associated with the starter lever 10, is connected to a reward-credit switch 41 associated with the reward-credit button 16, is connected to credit-play switch 42 associated with the credit-play button 18, and is connected to the aforementioned test signal generator 33.

The I/O port 35 is connected to a credit LED driver 47 for actuating the credit LED 17, is connected to a pay-out LED driver 50 for actuating an LED in the pay-out LED 15, is connected to a reel control circuit 54 for driving stepping motors 51 to 53 for rotating respectively the reels 5 to 7, is connected to a dispenser driver 56 for driving a coin dispenser 55 for paying out coins, is connected to a lamp driver 58 for actuating an error lamp 57, is connected to a speaker driver 60 for driving a loud speaker 59 arranged in the loudspeaker box 19, and is connected to a game inhibitor 68 for disabling a game. As soon as a difficulty is detected, the game inhibitor 68 responds to a signal generated from the CPU 30 and interrupts normal execution of the game-processing program e.g. by inhibiting the power supply from supplying the dispenser driver 56 with power. The interrupt state is terminated by a reset circuit 69 generating a reset signal.

Figure 3:
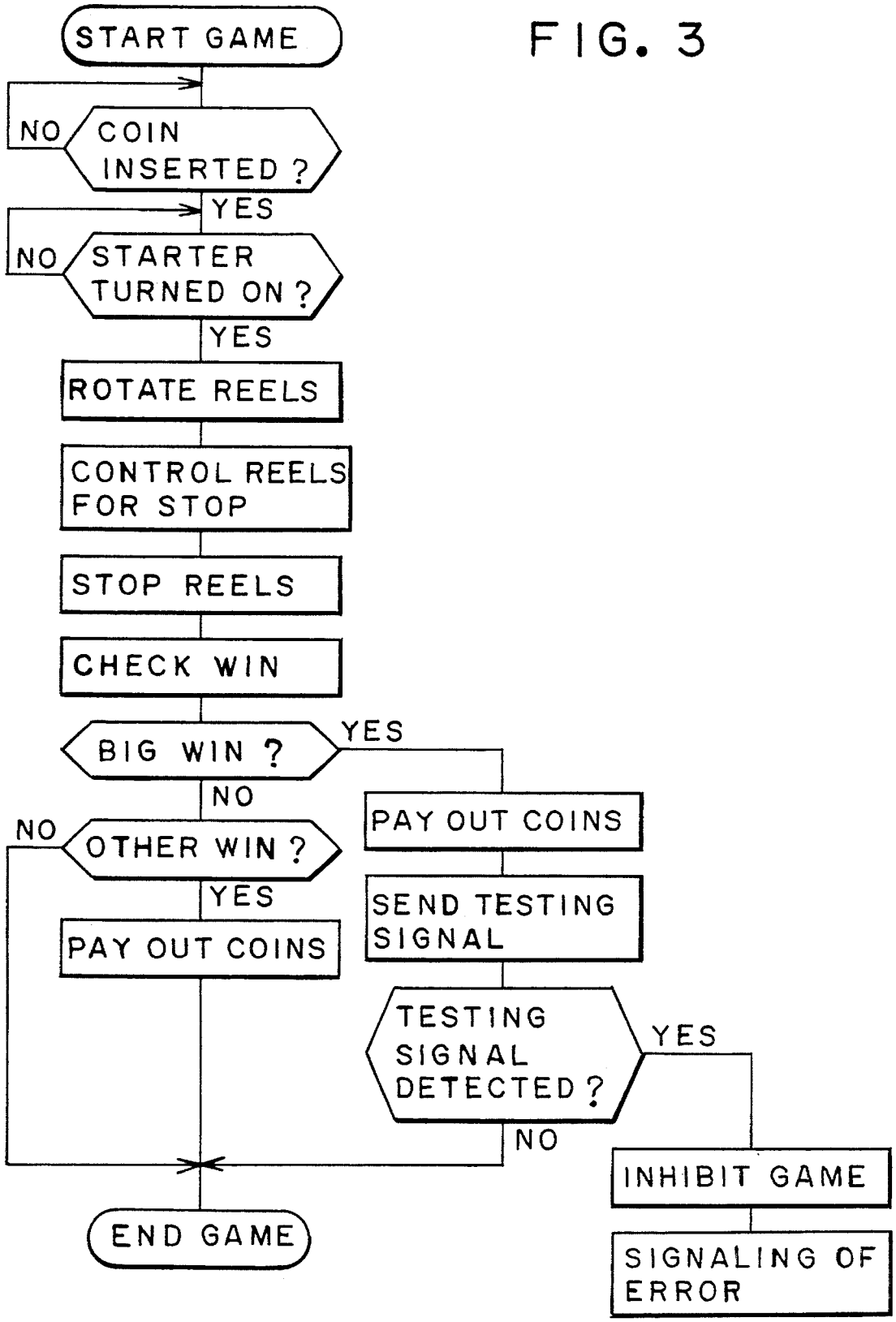
FIG. 3 is a flow chart illustrating the control steps of the slot machine.

The operation of the slot machine as constructed above will now be described with reference to FIG. 3. One to three acceptable coins C are first inserted through the coin slot 8. The coin sensor 36 outputs a detection signal to the CPU 30. The CPU 30, following the program stored in the ROM 32, brings the starter 10 to standby and validates winning lines of a number corresponding to the number of the coins C inserted. If the reward-credit button 16 has been turned on, more than three coins C are insertable. In such a case, the credit LED 17 indicates the number of coins remaining as a credit, after subtracting three from the total number of inserted coins C.

With the starter lever 10 actuated, one number is sampled at random from a train of random numbers within a predetermined range. All the numbers to be sampled randomly are arranged in four groups, namely, a big win, a medium win, a small win and a loss. The date on the random numbers is stored in the ROM 32. The CPU 30, according to the data and that one random number, determines one of the four types of win or loss for the game to be played, and causes the reel control circuit 54 to rotate the stepping motors 51 to 53 so as to start the reels 5 to 7.

The stop buttons 11 to 13 are depressed to cause the respective stop switches 37 to 39 to send reel-stop signals to the CPU 30, which then causes the reel control circuit 54 to stop the stepping motors 51 to 53 and then the reels 5 to 7 while controlling them so as to show symbols along the winning line or lines in accordance with a combination corresponding to the specified type of win or loss.

After the reels stop, the CPU 30 receives outputs from position sensors 65 to 67 and checks the actual positions of stopping of the reels 5 to 7. If the symbol combination corresponds to a big win for example, with the stopped positions confirmed, the CPU 30 sends to the dispenser driver 56 a pay-out signal for a big win. The dispenser driver 56 drives the coin dispenser 55 to pay out coins in a number corresponding to the big win into the receptacle 14, to end one game. The slot machine is constructed in such a manner that it is necessary that, after a game ends with a big win, an employee of the amusement facility enters a signal via a key switch to the CPU 30.

In response to the end of the game with a big win, the CPU 30 performs a sequence to detect fraud before the key switch is operated by the operator. The CPU 30 drives the test signal generator 33, and causes the I/O port 34 to generate pulsed test signals to signal lines **37*a* to 42*a* connected to switches 37 to 42, to detect whether any of the signal lines is fraudulently connected via a connection FC to the signal line 36*a* of the coin sensor 36. If the CPU 30, checking the signal line 36*a*, finds it has output the pulse signal to any of the signal lines 37*a* to 42*a*, then the CPU 30 sends drive signals to the game inhibitor 68, the pay-out LED driver 50, the lamp driver 58 and the speaker driver 60. The game inhibitor 68 interrupts a line from the power supply to the coin dispenser 55 and the like. An error is indicated on the pay-out LED 15 actuated by the pay-out LED driver 50, and the error lamp 57 is actuated by the lamp driver 58. The speaker driver 60 drives the speaker 59 so as to signal the error acoustically. Not only the signal from the key switch, but also a reset signal from the reset circuit 69, is necessary to start another game after operation of the game inhibitor 68**.

If the symbols in the stopped position are in the combination of a medium or small win, the CPU 30 sends a pay-out signal corresponding to a medium or small win to the dispenser driver 56, so as to drive the coin dispenser 55 to pay out coins in a predetermined number, whereupon the game is ended. When the symbols in combination are judged to be a loss, the CPU 30 ends the game without paying out any coins. The CPU 30, according to the present embodiment, sends a pulsed test signal to the signal lines **37*a* to 42*a* from the signal generators 37 to 42 other than the coin sensor 36, to detect a possible connection between signal lines. Alternatively the CPU 30 can send a pulsed test signal to the signal line 36***a* of the coin sensor 36, while checking the other signal lines 37*a* to 42*a*, to detect a possible connection between signal lines.

In the above embodiment, the slot machine is constructed in such a manner that the existence of a fraudulent additional connection is detected after a game ends with a big win. Alternatively, the slot machine can be constructed so that the existence of a fraudulent additional connection is detected after a game ends with any win, whether big, medium or small. Any fraudulent additional connection FC between the line 36*a* of the coin sensor 36 and one of the lines 37*a* to 39*a* from the stop switches 37 to 39 can be detected, so that no game will be played without inserting coins C. In this way, no coins will ever be paid out responsive to fraud.

Figure 4:
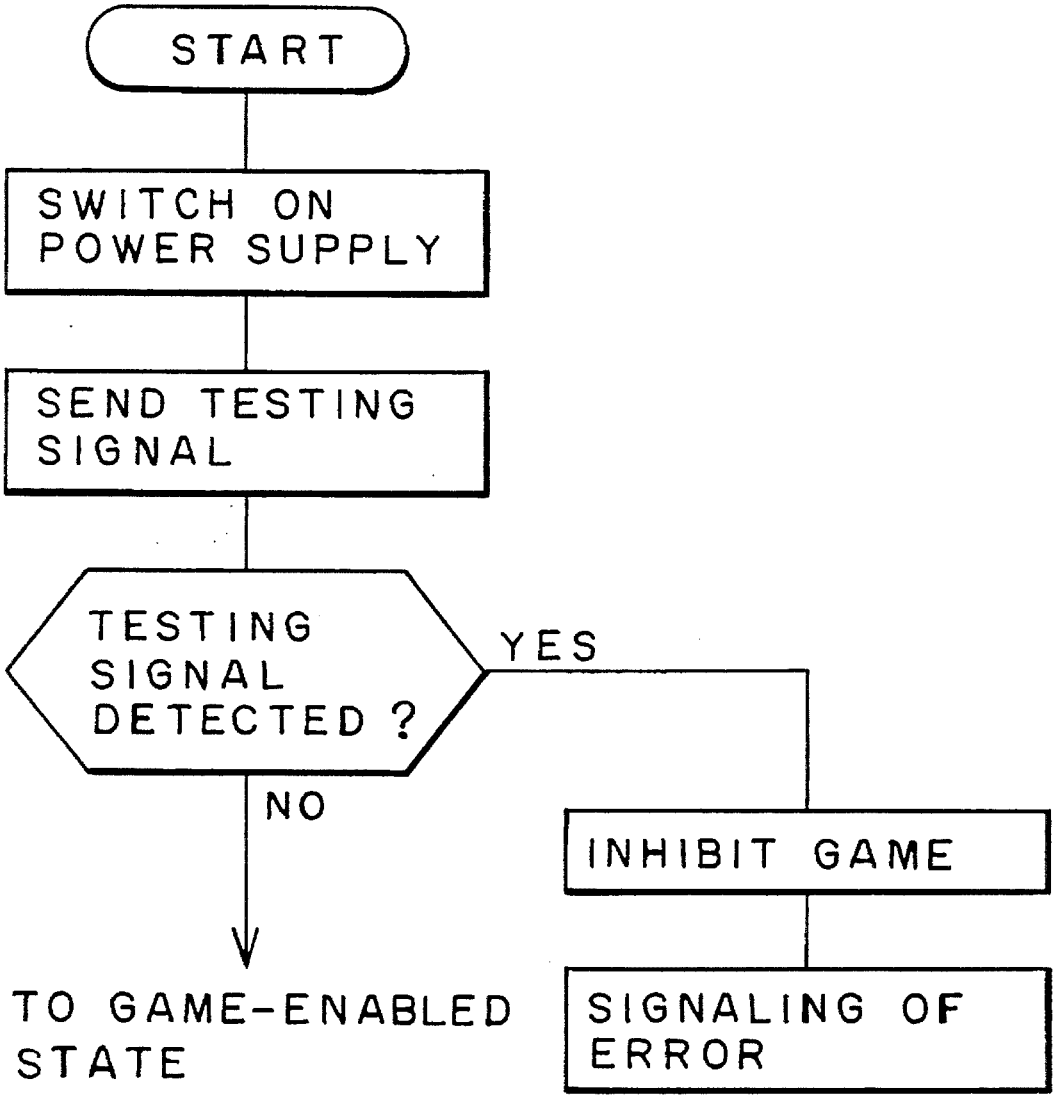
FIG. 4 is a flow chart illustrating another preferred embodiment of control of a novel slot machine.

FIG. 4 illustrates another preferred embodiment in which the test signal generator 33 is differently used, according to a different program stored in the ROM. The slot machine is programmed so that, in response to power initially supplied to the slot machine, the CPU 30 performs a sequence to detect fraud. If a pulsed test signal is detected from the signal line 36*a* in response to sending test signals to the other signal lines 37*a* to 42*a*, then the CPU 30 actuates the game inhibitor 68 to interrupt a line from the power supply to the coin dispenser 55 and the like, actuates the pay-out LED 15 and the error lamp 57 for indication of the error, and actuates the loud speaker 59 for signaling the error. This has the advantage that fraud can be prevented before players play any games at all. If no pulsed test signal is detected from the signal line 36*a* in response to sending test signals to the other signal lines 37*a* to 42*a*, then the CPU 30 executes the normal sequence of playing a game.

Although the present embodiment is described for use with slot machines, the present invention is applicable to other gaming machines, such as pinball machines into which one or more coins are inserted to start a game. In the above embodiment, the existence of a fraudulent additional connection is detected between the signal line 36*a* of the coin sensor 36 and those 37*a* to 42*a* of the other signal generators 37 to 42. Alternatively, the existence of a fraudulent additional connection is detected between the signal line 42*a* of the credit-play switch 42 and the signal lines 37*a* to 41*a* of the other signal generators 37 to 41 so as to detect a fraud.

In the above embodiment, three stop buttons are arranged on the slot machine. Instead, a novel slot machine can be provided with a single stop button. Such a single stop button may be adapted to be depressed three times for stopping the reels one by one, or it may be adapted for one-time depression for stopping the reels sequentially in a predetermined sequence.

In the above embodiment, coins C are used. Alternatively, a novel gaming machine can be used with a prepaid card, on which a predetermined value has been previously stored, which is inserted into the gaming machine, in which a bet or wager is deducted by decrementing from the stored value, and a reward is provided by registering it on the card.

Although the present invention has been fully described by way of the preferred embodiments thereof with reference to the accompanying drawings, various changes and modifications will be apparent to those having skill in this field. Therefore, unless otherwise these changes and modifications depart from the scope of the present invention, they should be construed as being included therein.

What is claimed is:

1. A gaming machine in which a reward is determined in accordance with a result of playing a game, comprising:

a controller for executing said game;

first signal generator means for generating a first signal in response to a first external operation so as to send said first signal to said controller;

second signal generator means for generating a second signal in response to a second external operation so as to send said second signal to said controller; and test signal generator means for sending a test signal toward a selected one of said first and second signal generator means, said controller checking a signal from the remaining one of said first and second signal generator means during generation of said test signal and, if said test signal is detected in said checked signal, inhibiting payment of said reward, detection of said test signal indicating fraudulent operation of the gaming machine;

said test signal generator means and said gaming machine receiving power from a common power supply.

2. A gaming machine as defined in claim 1, further comprising third signal generator means for generating a third signal in response to a third external operation, and wherein said test signal generator means sends said test signal toward a specified one of said first to third signal generator means, and said controller checks signals from the remaining two of said signal generator means, or said test signal generator means sends said test signal toward said remaining two signal generator means, and said controller checks a signal from said specified one signal generator means.

3. A gaming machine as defined in claim 2, wherein said third signal generator means comprises at least one of a starting switch, a reward-crediting switch, and a credit-playing switch.

4. A gaming machine as defined in claim 1, wherein said first external operation is to play a bet.

5. A gaming machine as defined in claim 4, wherein said reward and said bet are each constituted of at least one coin.

6. A gaming machine as defined in claim 5, wherein said first signal generator means is a coin sensor for detecting said coin as played.

7. A gaming machine as defined in claim 1, which is a slot machine, and further comprises a plurality of reels, and wherein said second signal generator means is operated to stop at least one of said reels.

8. A gaming machine as defined in claim 7, wherein there are three reels, and said second signal generator means comprises three stop switches corresponding respectively to said reels.

9. A gaming machine as defined in claim 1, wherein, when said fraudulent operation is detected, further games are prevented from execution.

10. A gaming machine as defined in claim 1, further comprising:

pay-out means for paying out said reward; and inhibiting means controlled by said controller for inhibiting said pay-out means when said fraudulent operation is detected.

11. A gaming machine as defined in claim 1, further comprising warning means for indicating when said fraudulent operation is detected.

12. A gaming machine as defined in claim 11, wherein said warning means includes at least one of a speaker and an indicator for signaling said fraudulent operation at least one of acoustically and visually.

13. A gaming machine as defined in claim 1, wherein said test signal generator means generates said test signal when power is supplied initially to said machine.

14. A gaming machine as defined in claim 1, wherein said test signal generator means generates said test signal when said game providing said reward is ended.

15. A gaming machine as defined in claim 1, wherein said test signal is generated when a game providing a reward determined as biggest is ended.

16. A gaming machine which, in response to a first external operation, becomes enabled to execute a game, and in which said game is executed while said machine is enabled to execute said game so as to determine a reward, comprising:

a controller for executing said game;

first signal generator means connected to said controller via a signal line for generating a first signal representing a game-enabled state in response to said first external operation;

second signal generator means connected to said controller via a signal line for generating a second signal in response to a second external operation performed before determination of said reward; and test signal generator means for outputting a test signal to said signal line of a selected one of said first and second signal generator means, said controller checking said signal line of the remaining one of said first and second signal generator means during generation of said test signal and, if said test signal is detected through said signal line of said remaining one signal generator means, inhibiting payment of said reward, detection of said test signal indicating fraudulent operation of said gaming machine;

said test signal generator means and said gaming machine receiving power from a common power supply.

17. A gaming machine as defined in claim 16, which further comprises third signal generator means for generating a third signal in response to a third external operation, and wherein said test signal generator means sends said test signal toward a specified one of said first to third signal generator means, and said controller checks signals from the remaining two of said signal generator means, or said test signal generator means sends said test signal toward said remaining two signal generator means, and said controller checks a signal from said specified one signal generator means.

18. A method of detecting fraudulent operation in a gaming machine by a test signal generating means, said gaming machine and said test signal generating means receiving power from a common power supply;

wherein, a first signal enabling execution of a game is input upon a first external operation to a controller through a first signal line, a second signal is input upon a second external operation to said controller through a second signal line, and thereafter a reward for said game is determined, said method comprising the steps of:

outputting a test signal to said second signal line;

checking said first signal line; and if said test signal is detected through said first signal line, inhibiting payment of said reward, detection of said test signal indicating said fraudulent operation.

19. A fraud detecting method as defined in claim 18, wherein said gaming machine is a slot machine having a plurality of reels, and wherein said second signal is input to stop said reels.

20. A fraud detecting method as defined in claim 18, wherein said first external operation is to play a bet.

21. A fraud detecting method as defined in claim 19, wherein a third signal is input upon a third external operation to said controller through a third signal line, and said test signal is output to a specified one of said first to third signal lines, and said controller checks signals from the remaining two of said signal lines, or said test signal is output to said remaining two signal lines, and said controller checks a signal from said specified one signal line.

22. A fraud detecting method as defined in claim 21, wherein said third signal line comprises at least one of respective signal lines from a starting switch, a reward-crediting switch, and a credit-playing switch.

23. A method of detecting fraudulent operation in a gaming machine by a test signal generating means, said gaming machine and said test signal generating means receiving power from a common power supply;

wherein, a first signal enabling execution of a game is input upon a first external operation to a controller through a first signal line, a second signal is input upon a second external operation to said controller through a second signal line, and thereafter a reward for said game is determined, said method comprising the steps of:

outputting a test signal to said first signal line;

checking said second signal line; and if said test signal is detected through said second signal line, inhibiting payment of said reward, detection of said test signal indicating said fraudulent operation.

24. A fraud detecting method as defined in claim 23, wherein said third signal line comprises at least one of respective signal lines from a starting switch, a reward-crediting switch, and a credit-playing switch.

* * * * *